US005728294A

United States Patent [19]

Deming

[11] Patent Number: 5,728,294

[45] Date of Patent: Mar. 17, 1998

[54] DRAIN CLOSURE APPARATUS

[76] Inventor: John P. Deming, P. O. Box 612516, San Jose, Calif. 95161

[21] Appl. No.: 627,953

[22] Filed: Apr. 3, 1996

Related U.S. Application Data

[62] Division of Ser. No. 386,822, Feb. 10, 1995, Pat. No. 5,582,720.

[51] Int. Cl.[6] ..... E03F 5/06; E02D 29/14

[52] U.S. Cl. ..... 210/164; 52/20; 52/302.7; 404/4; 404/25

[58] Field of Search ..... 52/20, 21, 302.1, 52/308.7; 210/163, 164; 404/25, 26, 4

[56] References Cited

U.S. PATENT DOCUMENTS

| | | | |
|---|---|---|---|
| 1,195,827 | 8/1916 | Lucke | 210/163 X |
| 1,900,658 | 3/1933 | Niedecken | 210/164 |
| 2,097,044 | 10/1937 | Riddle | 210/164 X |
| 2,246,390 | 6/1941 | Smith | 210/164 |
| 2,504,474 | 4/1950 | Van Oss | 210/163 |
| 2,783,852 | 3/1957 | Sisk | 210/165 |
| 3,349,917 | 10/1967 | Strickland | 210/164 |
| 4,136,010 | 1/1979 | Pilie et al. | 210/164 |
| 4,348,279 | 9/1982 | Tikhonov et al. | 210/533 |
| 4,419,232 | 12/1983 | Arntyr et al. | 210/164 |
| 4,621,939 | 11/1986 | Thomann et al. | 210/164 X |
| 4,650,365 | 3/1987 | Runnels | 404/4 |
| 4,971,477 | 11/1990 | Webb et al. | 405/52 |
| 4,986,907 | 1/1991 | Montemayor Uzeta | 210/533 |
| 5,092,251 | 3/1992 | Hamaker et al. | 108/51.1 |
| 5,117,877 | 6/1992 | Sharp | 405/52 |

FOREIGN PATENT DOCUMENTS

| | | | |
|---|---|---|---|
| 0555868 | 4/1958 | Canada | 210/163 |

*Primary Examiner*—Carl D. Friedman
*Assistant Examiner*—Winnie Yip
*Attorney, Agent, or Firm*—Fliesler, Dubb, Meyer & Lovejoy

[57] ABSTRACT

A drain closure apparatus for closing a storm drain, or other type of drain, in a fluid-tight manner so as to prevent a flow of hazardous materials into the drain. The closure member comprises a first cover member having an outside diameter and a peripheral edge which corresponds to the outside diameter and peripheral edge of an existing drain cover member covering a drain to enable seating and supporting the first cover member in the drain in place of the existing drain cover member, a second cover member in a hole provided therefor in the center of the first cover member, said second cover member having holes in the top thereof so as to permit a flow of fluid through the second cover member and into the drain, a closure member, and a threaded rod for moving the closure member between a first position and a second position as the second cover member is rotated to selectively close the drain in a fluid-tight manner.

5 Claims, 4 Drawing Sheets

DRAIN CLOSURE APPARATUS

This application is a divisional of Ser. No. 08/386,822, filed Feb. 10, 1995, now U.S. Pat. No. 5,582,720.

BACKGROUND OF THE INVENTION

1. Field of the Invention

The present invention relates to apparatus for handling hazardous materials in general and in particular to an apparatus for closing a storm drain, or other type of drain, in a fluid-tight manner so as to prevent a flow of hazardous materials into the drain.

2. Description of the Related Art

Among the most serious problems associated with the handling of hazardous materials is the accidental discharge of such materials into a drain which leads to a sewage treatment plant which is not equipped to handle such materials, or into a storm drain which ultimately flows into a creek, river, lake, bay, or the like. In either case, the cost of containing and cleaning up the material can be enormous both financially and in terms of the negative impact on the environment.

The manufacture of semiconductor products, for example, involves the use of hazardous materials which are usually stored in exterior tanks outside the walls of the manufacturing facility. Not infrequently, storm drains and the like which are used to collect rain water are found in the vicinity of the exterior storage tanks.

The material in the tanks is periodically replenished from a tanker truck or the like. If through negligence or by accident the material is spilled on the ground during the filling of the tanks, it could be collected by a nearby storm drain, resulting in the above-described adverse consequences.

Presently, companies seek to prevent the loss of hazardous materials in a storm drain by covering the drain with an absorbent blanket, such as a SpillMat made by Lab Safety Supply of Janesville, Wis., or by surrounding the drain with piles of absorbent material, such as Safe-T-Sorb, available from Orchard Supply Hardware, Sunnyvale, Calif., either before an accidental spill as a preventive measure or afterwards to minimize the damage caused by the spill. Sometimes the edges of the blanket are required to be held down by some sort of heavy object such as, for example, bags of absorbent material.

When the spilled material is a liquid, the use of a bag of absorbent material, or the like, to prevent the liquid material from flowing beneath the edges of the blanket is not always successful. Furthermore, the absorbent blankets which are currently being used for this purpose are expensive and must be replaced as soon as they have become saturated with any liquid, including ordinary rainwater, because, after they are saturated, they no longer will hold any additional liquid. Also, the need to hold down the edges with heavy objects is time consuming and labor intensive. There are also spill mats available that do not absorb the liquid and are used as dams to prevent the liquids from entering the drain. However, where the liquid is hazardous liquid the spill mats still become contaminated and must either be decontaminated or disposed of as hazardous matter. Moreover, when not used to cover or dam a drain, the blanket or spill mats are usually stored in a pile immediately adjacent to the drain and is therefore unsightly. Further, if the drain is in a traffic area, the blanket or spill mats must be stored some distance from the drain and are therefore more likely not to be immediately available for use in case of a spill.

When loose material is used to absorb a spill, the material must be cleaned up after the spill and if the spill contained hazardous matter then loose material must be disposed as hazardous matter and further must itself be not allowed to enter the drain system.

SUMMARY OF THE INVENTION

In view of the foregoing, a principal object of the present invention is an apparatus for closing a storm drain, or other type of drain, in a fluid-tight manner so as to prevent a flow of hazardous materials into the drain.

In accordance with the above object there is provided a first cover member having an outside diameter and a peripheral edge which corresponds to the outside diameter and peripheral edge of an existing drain cover member covering a drain to enable seating and supporting the first cover member in the drain in place of the existing drain cover member, a second cover member in a hole provided therefor in the center of the first cover member, said second cover member having holes in the top thereof so as to permit a flow of fluid through the second cover member and into the drain, a closure member, and means for moving the closure member between a first position and a second position to selectively close the drain in a fluid-tight manner so as to prevent a flow of hazardous materials through the holes in the second cover member and into the drain.

In a preferred embodiment of the present invention the closure member is a disk-shaped member, a threaded rod extends from the second cover member for engaging corresponding mating threads in a central bore of said disk-shaped member and the means for moving the closure member between a first position and a second position to selectively close the drain in a fluid-tight manner comprises means for moving the disk-shaped member between the first and second positions by rotating the second cover member and threaded rod extending therefrom. A means is also provided for preventing a rotation of the disk-shaped member as the second cover member and threaded rod are rotated.

A principal advantage of the closure apparatus of the present invention is that it can be opened and closed manually without any tools or by simply inserting a forked tool into holes in the second cover member and rotating the tool to rotate the second cover member and the threaded rod extending therefrom. By using a tool of sufficient length, the person operating the closure need not bend over or put their hand in the hazardous or other material accumulating at the drain.

BRIEF DESCRIPTION OF THE DRAWINGS

The above and other objects, features and advantages of the present invention will become apparent from the following detailed description of the accompanying drawings, in which.

DETAILED DESCRIPTION OF THE INVENTION

Figure 1:
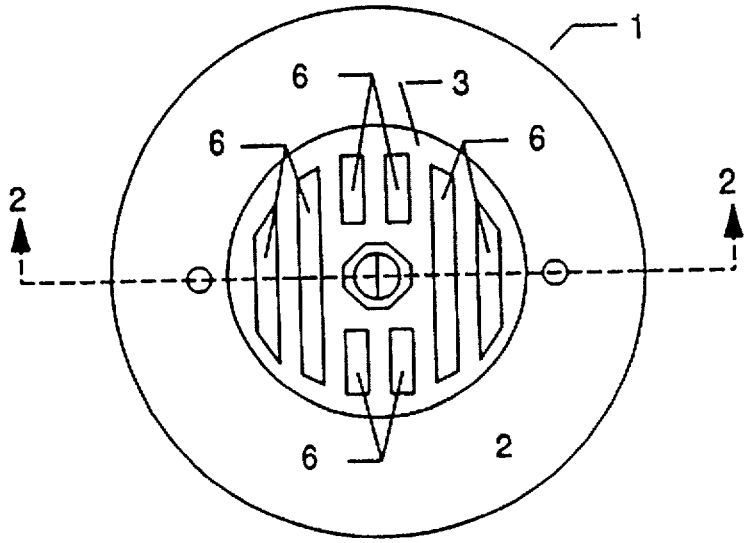
FIG. 1 is a plan view of a drain closure apparatus according to the present invention.
Figure 2:
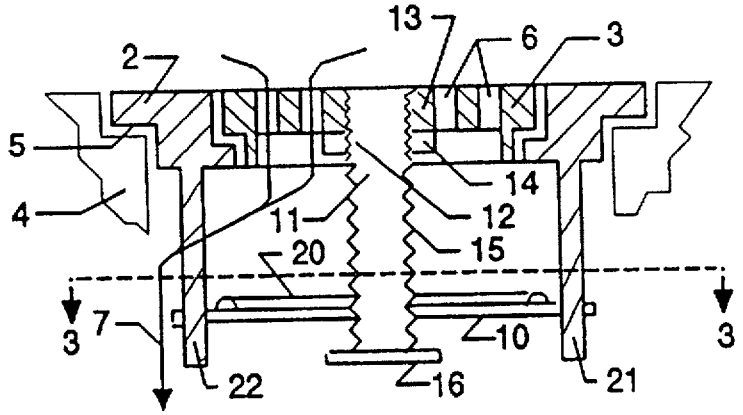
FIG. 2 is an elevation cross-sectional view taken in the direction of lines 2—2 of FIG. 1.

Referring to FIGS. 1 and 2, there is provided in accordance with the present invention a drain closure apparatus designated generally as 1. In the apparatus 1 there is provided a first cover member designated generally as 2 and a second cover member designated generally as 3. The first cover member 2 has an outside diameter, e.g. 24 inches, and a peripheral edge, e.g. inverted L-shaped shoulder, as shown at 4 which corresponds to the outside diameter and peripheral edge of an existing drain cover member (not shown) covering a drain designated generally as 5 to enable seating and supporting the first cover member 2 in the drain 5 in place of the existing drain cover member. The second cover member 3 is seated in a hole provided therefor in the center of the first cover member 2. The second cover member 3 is provided with a plurality of holes 6 in the top thereof so as to permit a flow of fluid through the second cover member 3 and into the drain 5 as shown by the arrows 7. The diameter of the second cover member is approximately 9 inches but may be larger or smaller to accommodate a particular application. Its peripheral edge is preferably an inverted L-shaped edge to mate with a corresponding edge in the hole in which the cover member 3 is seated.

Figure 3:
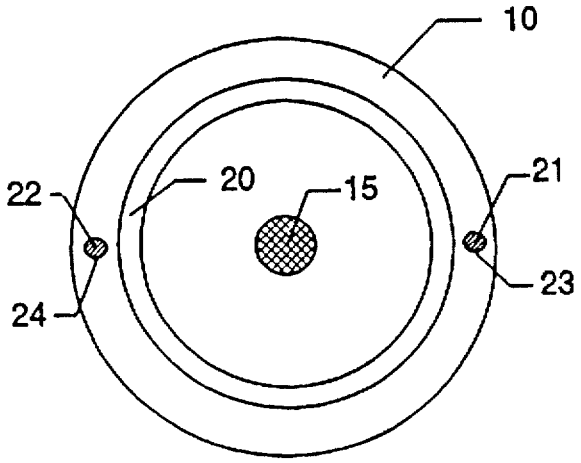
FIG. 3 is a plan view of a disk-shaped closure member according to the present invention taken in the direction of lines 3—3 of FIGS. 2.

Referring to FIGS. 2 and 3, mounted below the cover members 2 and 3 there is provided a disk-shaped closure member designated generally as 10. Extending from the center of the second cover member 3 there is provided a threaded rod 11. The upper end of rod 11 is provided with a first set of threads 12 for threading the rod 11 into a retaining nut-like structure 13. A locking nut 14 is used for locking the threaded rod 11 in position in the second cover member 3. Below the threads 12 the threaded rod 11 is provided with a second set of threads 15 which are relatively large and generally correspond to the type of threads used on a light bulb. That is to say, the threads 15 are sufficiently large enough so that dirt and the like does not prevent their being threaded into mating threads in the center of the disk closure member 10. At the bottom of the threaded rod 11 there is provided a stopper 16 for retaining the disk-shaped closure member 10 on the threaded rod 11. Mounted to the top of the disk-shaped closure member 10 there is provided a sealing ring 20. The sealing member 20 is provided for making a fluid-tight seal with the undersurface of the first cover member 2 when the disk-shaped closure member 10 is moved from its first open position as shown in FIG. 2 to a second or closed position when the disk-shaped closure member is moved against the undersurface of the first cover member 2 by rotation of the second cover member 3 and threaded rod 11.

Extending downward from the first cover member 2 there is provided a plurality of rod members 21 and 22. Rod members 21 and 22 are provided to project through holes 23 and 24 provided therefor at diametrically opposed positions near the periphery of the disk-shaped closure member 10, as seen more clearly in FIG. 3. The rods 21 and 22 prevent rotation of the disk-shaped closure member 10 when the second cover member 3 and threaded rod 11 are rotated.

Figure 4:
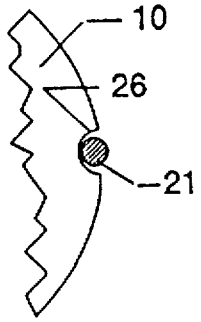
FIG. 4 is a partial plan view of an alternative disk-shaped closure member according to the present invention.

Referring to FIG. 4, in an alternative embodiment of the present invention the rods 21 and 22 project downward from the first cover member 2 to lie in slots 26 provided therefor at diametrically opposed positions on the periphery of the disk-shaped closure member 10. The function of the rods 21 and 22 in the embodiment of FIG. 4 is the same as that described above with respect to the embodiment of FIG. 3.

Figure 5:
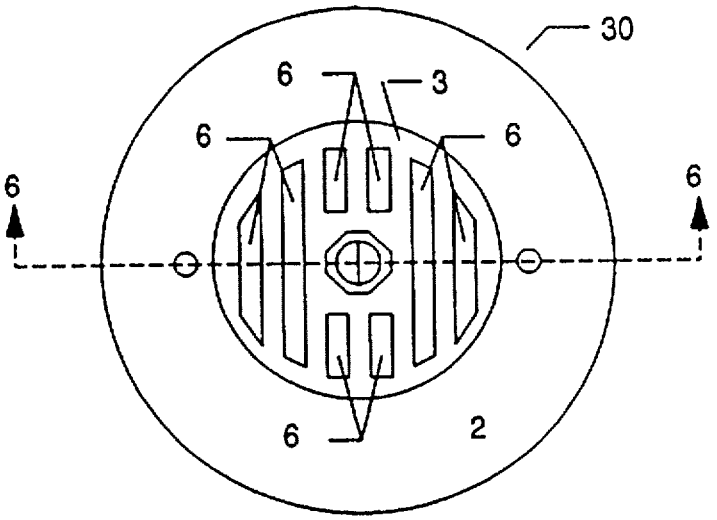
FIG. 5 is a plan view of an alternative drain closure apparatus according to the present invention.
Figure 6:
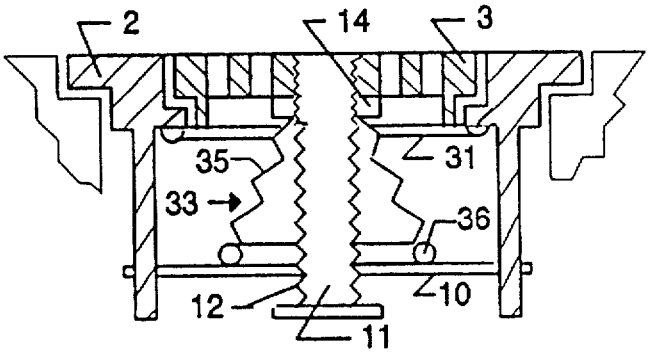
FIG. 6 is a side elevation cross-sectional view taken in the direction of lines 6—6 of FIG. 5.

Referring to FIGS. 5 and 6, there is provided in another embodiment of the present invention a drain closure apparatus designated generally as 30. The apparatus 30 is substantially identical to the apparatus 1 of FIGS. 1 and 2 except as hereinafter provided.

In the apparatus 30 there is provided a sealing member 31. The sealing member 31 is identical to the sealing member 20 of the apparatus 1 of FIGS. 1 and 2 but is mounted to the undersurface of the first cover member 2.

Mounted to the locking nut 14 and extending downward therefrom there is provided a flexible boot assembly 33. In the boot assembly 33 there is provided a flexible boot 35. The boot 35 is provided to deflect dirt and other debris from the threads 12 on the rod 11. At the bottom of the boot 35 there is provided a substantially rigid ring 36. The ring 36 is provided to prevent the boot 35 from becoming entangled with the threads on the threaded rod 11 as the disk-shaped closure member 10 is moved to its closed position by rotation of the second cover member 3 and threaded rod 11 and the boot 35 collapses.

It should be understood that the flexible boot assembly 33 can also be used in the apparatus 1 of FIGS. 1 and 2 or may be omitted entirely from all of the embodiments if the movement of the disk-shaped closure member 10 along the threaded rod 11 is not affected by dirt or other debris becoming involved in the threads.

Figure 7:
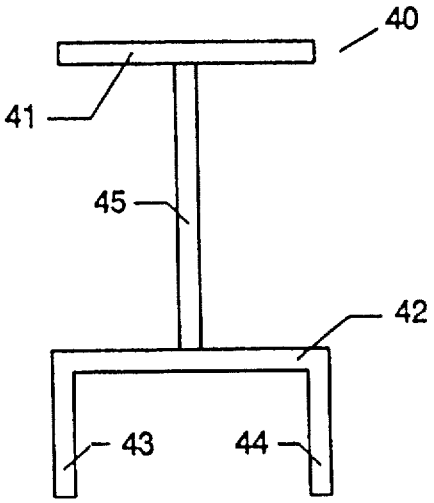
FIG. 7 is an elevation view of a tool used for opening and closing the closure member of the present invention.
Figure 8:
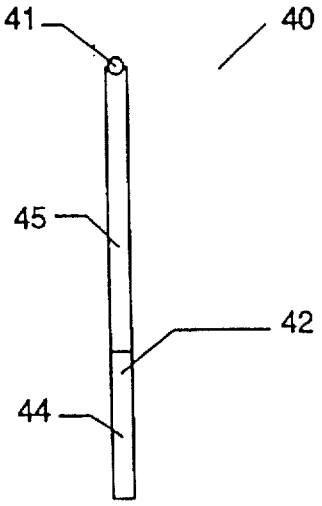
FIG. 8 is a side elevation view of the tool of FIG. 7.

Referring to FIGS. 7 and 8, there is provided a tool designated generally as 40 having a T-shaped handle 41 and a forked base 42 with downward extending legs 43 and 44. The downward legs 43 and 44 of the base 42 are provided to engage holes in the second cover member 3 such as the holes 6 to facilitate turning the second cover member 3 so as to move the disk-shaped closure member 10 between its first and second positions. The length of the shaft 45 in the tool 40 should be long enough to prevent the necessity for the operator thereof to bend over or to place his or her hand in the hazardous material or other material collecting at the drain 5.

Figure 9:
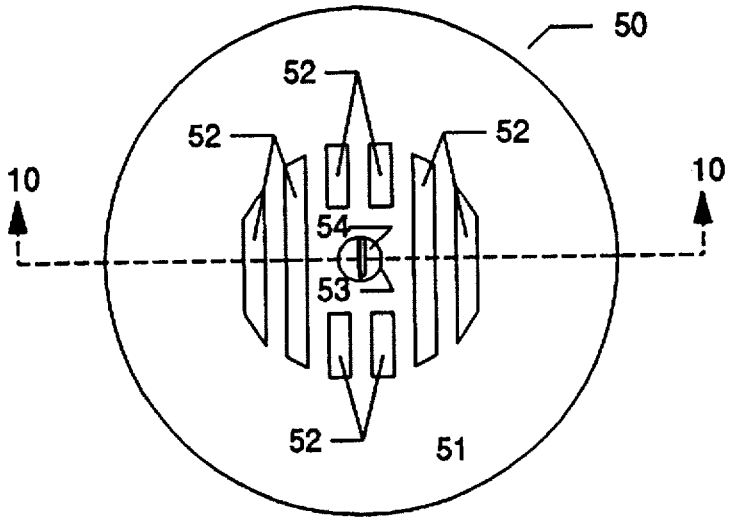
FIG. 9 is a plan view of an alternative drain closure apparatus according to the present invention.
Figure 10:
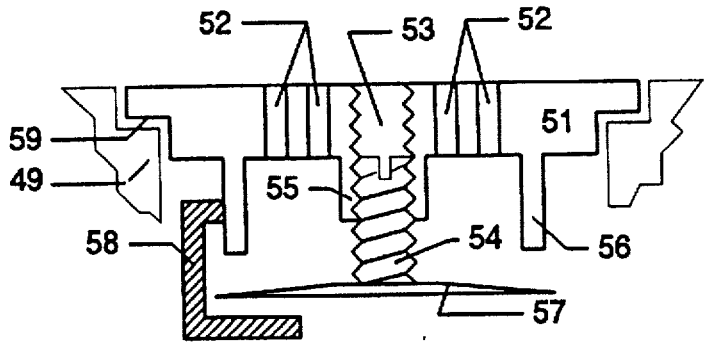
FIG. 10 is a is a side elevation cross-sectional view taken in the direction of lines 10—10 of FIG. 9.
Figure 11:
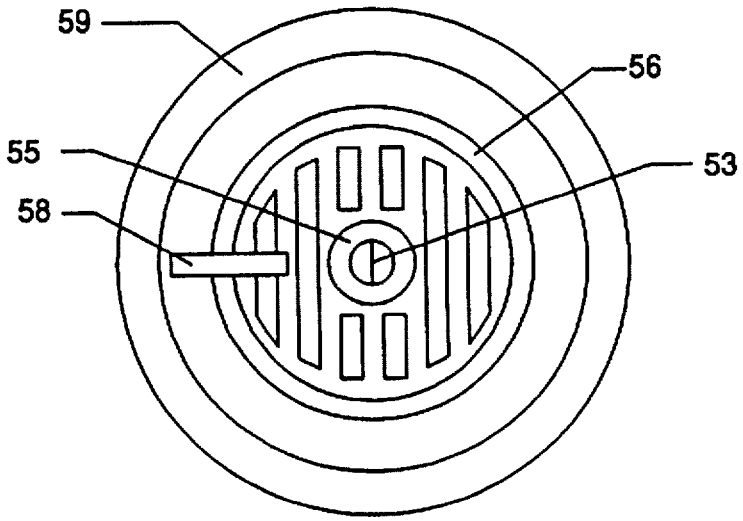
FIG. 11 is a bottom view the first cover member 51 of FIG. 9.

Referring to FIGS. 9, 10 and 11, there is provided in accordance with the present invention another alternative drain closure apparatus designated generally as 50. In the apparatus 50 there is provided a first cover member designated generally as 51 which has an outside diameter, e.g. 24 inches, and a peripheral edge, e.g. inverted L-shaped shoulder, as shown at 59 which corresponds to the outside diameter and peripheral edge of an existing drain cover member (not shown) covering a drain designated generally as 49 to enable seating and supporting the first cover member 50 in the drain 49 in place of the existing drain cover member. The first cover member 51 is provided with a plurality of holes 52 in the top thereof so as to permit a flow of fluid through the first cover member 51 and into the drain 49, as shown by the arrows 7.

Referring to FIGS. 10 and 11, extending from the center of the first cover member 51 there is provided a threaded rod 54. The upper end of rod 54 is provided with a first set of threads 55 for threading the rod 11 into a threaded shaft 53. The first set of threads 53 are relatively large and generally correspond to the type of threads used on a light bulb. That is to say, the threads 53 are sufficiently large enough so that dirt and the like does not prevent their being threaded into mating threads in shaft 53 in the center of the first cover member 51. At the bottom of the threaded rod 54 there is provided a stopper 57 for retaining the disk-shaped closure member 10 on the threaded rod 11. Extending from the bottom of first cover member 51 there is a sealing ring 56 surrounding all of the drain holes 52. At the bottom of the threaded rod 54 there is provided a stopper 57 which comes into contact with the bottom of the sealing ring to close the drain and to prevent fluids from entering into the drain system. Attached to the side of sealing ring 58 is travel control arm 58 which limits the downward travel of threaded rod 54 such that threaded rod 54 does not exit from shaft 53.

In operation the drain is closed by placing a screw driver type tool into the slot provided in the top of threaded rod 54 and rotating the threaded rod in a clockwise direction which will cause in turn rotate and raise stopper 57 until stopped 57 firmly seats against the bottom of sealing ring 56 thereby providing a liquid tight seal for preventing liquids from entering drain 49. The distance of travel of stopper 57 between the travel limit arm 58 and the bottom of sealing ring 56 is such that the top of threaded rod 54 will not extend above the top of first cover member 52 thereby preventing damage to threaded shaft 54 and always providing a flat even top surface for cover apparatus 50. When the drain is to be opened threaded shaft 54 is turned counter clockwise, separating stopper 57 from sealing ring 56 thereby allowing liquid to flow through cover apparatus 50 into the drain. The flow rate of the liquid through cover apparatus 50 can be controlled by the distance of stopper 57 from the bottom of sealing ring 56.

Figure 12:
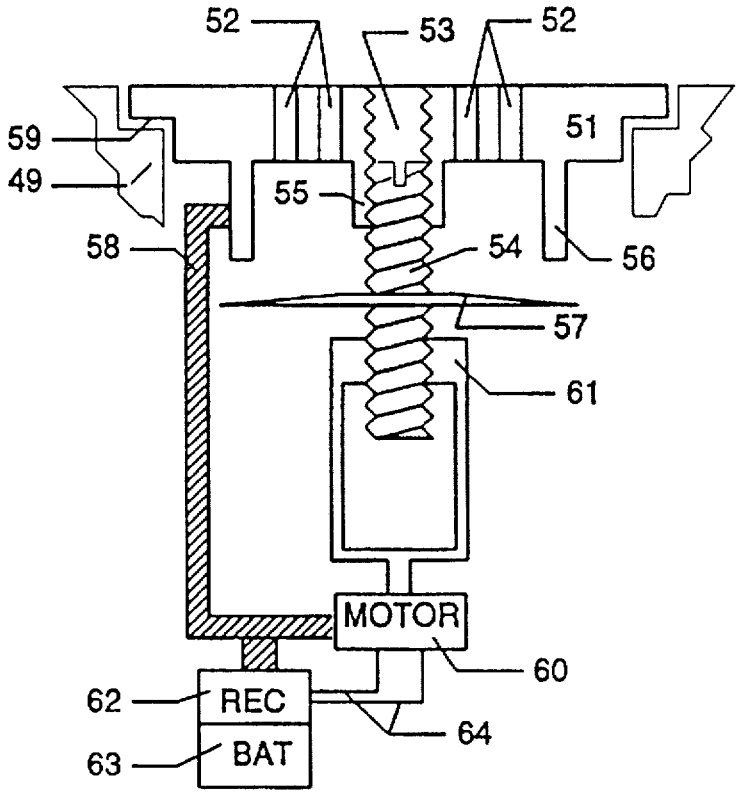
FIG. 12 is a side elevation cross-sectional view taken in the direction of line 10—10 of FIG. 9 showing a motorized version of the alternative drain closure apparatus of FIG. 9.

Referring to FIG. 12, there is shown the means for automatically controlling the drain closure apparatus of FIGS. 9, 10 and 11. Travel limit arm 58 has been extended in length and is now used to support dc motor 60, receiver 62 and battery pack 63. The threaded rod 54 has been extend and is threaded into motor shaft housing 61. Stopper 57 is connect to the middle of threader rod 54.

In operation a signal received by receiver 62 will control the operation of DC motor 60. Since the motor 60 is held in place, when shaft housing 61 is rotated by motor 60 the threaded rod 61 and stopper 57 will move upward or downward according to the direction of rotation of motor housing 60. Receiver 62 controls the direction of the DC current passing through DC motor 60 and therefore controls the direction of rotation of shaft housing 61. Therefore, the opening and closing of the drain closure apparatus of FIG. 9 can be remotely controlled. Further sensors could be installed which upon sensing the presence of hazardous liquids would flow through the drain closure apparatus and automatically send a signal to receiver 62 to close the drain closure apparatus.

While the automatic opening and closing means has been shown with respect to the alternative embodiment of FIG. 9, it should be understood that such an automatic opening and closing mechanism may be adapted to automatically controlling the embodiments of the invention shown in FIGS. 1 and 2 and in FIGS. 5 and 6.

While preferred embodiments of the present invention are described above, it is contemplated that modifications may be made thereto for particular applications without departing from the spirit and scope of the present invention. Accordingly, it is intended that the embodiments described be considered only as illustrative of the present invention and that the scope thereof should not be limited thereto but be determined by reference to the claims hereinafter provided.

What is claimed is:

1. An apparatus for closing a drain in a fluid-tight manner so as to prevent a flow of hazardous materials into the drain comprising:

a first cover member having an outside diameter and a peripheral edge for enabling seating and supporting of the first cover member; a plurality of drain holes in the first cover member so as to permit a flow of fluid through the first cover member and into the drain;

a sealing ring extending from a bottom of the first cover member and surrounding the plurality of drain holes in the first cover member;

a threaded shaft centered in the first cover member;

a threaded rod threaded into the threaded shaft of the first cover member;

a stopper attached to of the threaded rod for forming a liquid tight enclosure with the sealing ring to prevent liquid from flowing through the apparatus into the drain when the stopper is rotated firmly against a bottom of the sealing ring; and powered rotating means connected to the threaded rod for turning the threaded rod either clockwise or counter clockwise so as to open and close the apparatus.

2. The apparatus of claim 1 further comprising:

a travel limit arm attached to the first cover member for limiting the amount of downward travel of the threaded rod.

3. The apparatus of claim 1 wherein the powered rotating means includes:

a receiving means for allowing remote control of the power rotating means.

4. An apparatus for closing a drain in a fluid-tight manner so as to prevent a flow of hazardous materials into the drain comprising:

a first cover member having an outside diameter and a peripheral edge for enabling the seating and supporting of the first cover member in the drain;

a second cover member in a hole provided therefor in the center of the first cover member, said second cover member having holes in the top thereof so as to permit a flow of fluid through the second cover member and into the drain;

a closure member;

means for moving the closure member between a first position and a second position to selectively close the drain in a fluid-tight manner so as to prevent a flow of hazardous materials through the holes in the second cover member and into the drain; and powered rotating means connected to in opening and closing the apparatus.

5. The apparatus of claim 4 wherein the powered rotating means includes:

a receiving means for allowing remote control of the power rotating means.

* * * * *